US007665551B2

(12) United States Patent
Shahin et al.

(10) Patent No.: US 7,665,551 B2
(45) **Date of Patent: *Feb. 23, 2010**

(54) FLUSH MOUNTED SPIDER

(75) Inventors: David Shahin, Houston, TX (US); Karsten Heidecke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/566,482

(22) Filed: Dec. 4, 2006

(65) Prior Publication Data

US 2007/0144730 A1 Jun. 28, 2007

Related U.S. Application Data

(63) Continuation of application No. 10/999,520, filed on Nov. 30, 2004, now Pat. No. 7,143,849, which is a continuation of application No. 10/207,542, filed on Jul. 29, 2002, now Pat. No. 6,892,835.

(51) Int. Cl.
*E21B 19/10* (2006.01)

(52) U.S. Cl. ..... 175/423

(58) Field of Classification Search ..... 175/423; 166/88.2, 78.1, 75.14, 77.52
See application file for complete search history.

(56) References Cited

U.S. PATENT DOCUMENTS 1,469,894 A 10/1923 Clarke (Continued)

FOREIGN PATENT DOCUMENTS

CA 2 284 428 10/1999

(Continued)

OTHER PUBLICATIONS

EP Examination Report, Aplication No. 03 771 682.6, dated Mar. 12, 2007.

(Continued)

*Primary Examiner*—William Neuder
(74) *Attorney, Agent, or Firm*—Patterson & Sheridan, LLP

(57) ABSTRACT

A gripping apparatus for supporting a tubular includes a longitudinal opening extending therethrough. A bowl is formed on an inner wall of the housing to provide an incline surface for one or more gripping members. As the gripping members are move down along the incline, the incline causes the gripping members to move radially toward the tubular and contact the tubular. In one embodiment, the housing comprises two body portions coupled together using one or mores hinges. In one aspect, the bowl is formed as a recess in the inner wall of the housing. The hinges of the housing are progressively curved to accommodate the recess bowl, thereby increasing the tubular size handling capacity of the gripping apparatus. In another embodiment, the apparatus may include guide keys that mate with guide slots formed on an outer surface of the gripping members to minimize the rotational movement of the gripping members relative to the housing. In another embodiment, the apparatus may include a leveling ring connected to the one or more gripping members for synchronizing the movement of the one or more gripping members. In another embodiment still, the flange may include one or more blocks for mating with a rotary table. In another embodiment still, the apparatus may include one or more adjustable guide rollers to facilitate movement of the tubular within the housing.

19 Claims, 5 Drawing Sheets

U.S. PATENT DOCUMENTS

| | | | | | |
|---|---|---|---|---|---|
| 1,541,669 | A | | 6/1925 | Summers | |
| 1,983,545 | A | | 12/1934 | Johnson | |
| 2,061,772 | A | | 11/1936 | McLagan | |
| 2,063,361 | A | | 12/1936 | Baash | |
| 2,298,507 | A | | 10/1942 | Penick et al. | |
| 2,410,589 | A | | 11/1946 | Segelhorst | |
| 2,563,851 | A | | 8/1951 | Lundeen, et al. | |
| 2,589,159 | A | | 3/1952 | Stone | |
| 2,934,148 | A | | 4/1960 | Allaire | |
| 3,052,943 | A | | 9/1962 | Jones | |
| 3,188,708 | A | | 6/1965 | O'Haver | |
| 3,287,776 | A | | 11/1966 | Brown | |
| 3,330,354 | A | | 7/1967 | Chamblee | |
| 3,334,923 | A | | 8/1967 | Putch | |
| 3,579,752 | A | | 5/1971 | Brown | |
| 3,675,278 | A | * | 7/1972 | Powell | 294/102.2 |
| 3,722,603 | A | | 3/1973 | Brown | |
| 3,748,702 | A | | 7/1973 | Brown | |
| 4,332,062 | A | | 6/1982 | Byrne, Jr. | |
| 4,354,706 | A | | 10/1982 | Coyle, Sr. | |
| 4,381,584 | A | | 5/1983 | Coyle, Sr. | |
| 4,523,645 | A | | 6/1985 | Moore | |
| 4,579,379 | A | * | 4/1986 | Berg | 294/102.2 |
| 4,600,054 | A | | 7/1986 | Miller et al. | |
| 4,643,259 | A | | 2/1987 | Zeringue, Jr. | |
| 4,715,456 | A | | 12/1987 | Poe, Jr. et al. | |
| 4,823,919 | A | | 4/1989 | Hayatdavoudi | |
| 4,867,236 | A | | 9/1989 | Haney et al. | |
| 5,335,756 | A | | 8/1994 | Penisson | |
| 5,484,040 | A | | 1/1996 | Penisson | |
| 5,595,248 | A | | 1/1997 | Denny | |
| 5,609,226 | A | | 3/1997 | Penisson | |
| 5,848,647 | A | | 12/1998 | Webre et al. | |
| 6,089,338 | A | | 7/2000 | Bouligny, Jr. | |
| 6,192,981 | B1 | | 2/2001 | Boquet et al. | |
| 6,237,684 | B1 | | 5/2001 | Bouligny, Jr. et al. | |
| 6,378,399 | B1 | | 4/2002 | Bangert | |
| 6,536,520 | B1 | | 3/2003 | Snider et al. | |
| 6,595,288 | B2 | | 7/2003 | Mosing et al. | |
| 6,640,939 | B2 | | 11/2003 | Buck | |
| 6,668,684 | B2 | | 12/2003 | Allen et al. | |
| 6,845,814 | B2 | * | 1/2005 | Mason et al. | 166/75.14 |
| 6,892,835 | B2 | * | 5/2005 | Shahin et al. | 175/423 |
| 6,920,931 | B1 | | 7/2005 | Webre et al. | |
| 7,032,690 | B2 | | 4/2006 | Ramey et al. | |
| 7,096,948 | B2 | | 8/2006 | Mosing et al. | |
| 7,134,531 | B2 | | 11/2006 | Ramey et al. | |
| 7,267,168 | B1 | | 9/2007 | Sipos | |
| 2002/0074132 | A1 | | 6/2002 | Juhasz et al. | |
| 2003/0116326 | A1 | | 6/2003 | Dallas | |
| 2003/0164276 | A1 | | 9/2003 | Snider et al. | |
| 2003/0173073 | A1 | | 9/2003 | Snider et al. | |
| 2003/0173117 | A1 | | 9/2003 | Mason et al. | |
| 2004/0003490 | A1 | | 1/2004 | Shahin et al. | |
| 2004/0016575 | A1 | | 1/2004 | Shahin et al. | |
| 2004/0144547 | A1 | | 7/2004 | Koithan et al. | |
| 2004/0251050 | A1 | | 12/2004 | Shahin et al. | |
| 2004/0251055 | A1 | | 12/2004 | Shahin et al. | |
| 2005/0000691 | A1 | | 1/2005 | Giroux et al. | |
| 2005/0056420 | A1 | | 3/2005 | Ramey et al. | |

FOREIGN PATENT DOCUMENTS

| | | | |
|---|---|---|---|
| DE | 43 26 298 | | 3/1995 |
| DE | 198 14 033 | | 10/1999 |
| FR | 2 658 972 | | 8/1991 |
| GB | 2014215 | * | 8/1979 |
| GB | 2 355 030 | | 4/2001 |
| NO | 153865 | | 8/1979 |
| WO | WO 90/04698 | | 5/1990 |
| WO | WO 98/21443 | | 5/1998 |
| WO | WO 01/69034 | | 9/2001 |
| WO | WO 03/031766 | | 4/2003 |

OTHER PUBLICATIONS

Norwegian Office Action, Application No. 2004 2738, dated Dec. 24, 2007.

Canadian Office Action, Application No. 2,546,033, dated Apr. 30, 2009.

EP Search Report, Application No. 06270046.3-2315, dated Nov. 22, 2006.

EP Partial Search Report, Application No. 06270046.2-2315, dated Oct. 4, 2006.

PCT Search Report, International Application No. PCT/US 03/22761, dated Dec. 2, 2003.

EP Search Report Application No. 08 01 2836, dated Sep. 12, 2008.

* cited by examiner

FLUSH MOUNTED SPIDER

CROSS-REFERENCE TO RELATED APPLICATIONS

This application is a continuation of U.S. patent application Ser. No. 10/999,520, filed Nov. 30, 2004 now U.S. Pat. No. 7,143,849, which is a continuation of U.S. patent application Ser. No. 10/207,542, filed Jul. 29, 2002, now U.S. Pat. No. 6,892,835. The aforementioned related patent applications are herein incorporated by reference in their entirety.

BACKGROUND OF THE INVENTION

1. Field of the Invention

Embodiments of the present invention generally relate to a gripping apparatus for supporting tubulars. Particularly, the aspects of the present invention relate to slip type gripping assembly disposable within a rotary table.

2. Description of the Related Art

The handling of pipe strings has traditionally been performed with the aid of a spider. Typically, spiders include a plurality of slips circumferentially surrounding the exterior of the pipe string. The slips are housed in what is commonly referred to as a "bowl". The bowl is regarded to be the surfaces on the inner bore of the spider. The inner sides of the slips usually carry teeth formed on hard metal dies for engaging the pipe string. The exterior surface of the slips and the interior surface of the bowl have opposing engaging surfaces which are inclined and downwardly converging. The inclined surfaces allow the slip to move vertically and radially relative to the bowl. In effect, the inclined surfaces serve as a camming surfaces for engaging the slip with the pipe. Thus, when the weight of the pipe is transferred to the slips, the slips will move downwardly with respect to the bowl. As the slips move downward along the inclined surfaces, the inclined surfaces urge the slips to move radially inward to engage the pipe. In this respect, this feature of the spider is referred to as "self tightening." Further, the slips are designed to prohibit release of the pipe string until the pipe load is supported by another means.

In the makeup or breakup of pipe strings, the spider is typically used for securing the pipe string in the wellbore. Additionally, an elevator suspended from a rig hook is used in tandem with the spider. The elevator may include a self-tightening feature similar to the one in the spider. In operation, the spider remains stationary while securing the pipe string in the wellbore. The elevator positions a pipe section above the pipe string for connection. After completing the connection, the elevator pulls up on the pipe string to release the pipe string from the slips of the spider. Freed from the spider, the elevator may now lower the pipe string into the wellbore. Before the pipe string is released from the elevator, the spider is allowed to engage the pipe string again to support the pipe string. After the load of the pipe string is switched back to the spider, the elevator may release the pipe string and continue the makeup process.

Traditionally, a spider is located above a rotary table situated in the rig floor. More recently, flush mounted spiders have been developed so that the spider does not intrude upon the work deck above the rotary. Because flush mounted spiders reside within the rotary table, the pipe size handling capacity of the spider is limited by the size of the rotary table. Current spider designs further augment the problem of limited pipe size handling capacity. Thus, in order to handle a larger pipe size, a larger rotary table must be used. However, the process of replacing the existing rotary table is generally economically impractical.

Another drawback of some spiders currently in use is the guide plate for facilitating the axial movement of the pipe string. The guide plate is typically designed for use with a certain pipe diameter size. Therefore, the guide plate must be replaced when a different pipe size is used. Further, many spiders have slips that are held in position in the bowl by friction. As a result, only a limited amount of torque may be applied before slippage occurs between the slip and the bowl.

There is a need, therefore, for a gripping apparatus with increased pipe size handling capacity. There is a further need for a gripping apparatus having a guide plate capable of accommodating one or more pipe size. There is a further need for a gripping apparatus with increased torque capacity.

SUMMARY OF THE INVENTION

The present invention generally provides a gripping apparatus for supporting a tubular. The apparatus includes a housing having a longitudinal opening extending therethrough. A bowl is formed on an inner wall of the housing to provide an incline surface for one or more gripping members. As the gripping members are move down along the incline, the incline causes the gripping members to move radially toward the tubular and contact the tubular. In one embodiment, the housing comprises two body portions coupled together using one or mores hinges.

In one aspect, the bowl is formed as a recess in the inner wall of the housing. The hinges of the housing are progressively curved to accommodate the recess bowl, thereby increasing the tubular size handling capacity of the gripping apparatus.

In another aspect, the apparatus may include one or more guide keys disposed on the surface of the bowl. The guide keys mate with guide slots formed on an outer surface of the gripping members. The guide slot and guide keys minimize the rotational movement of the gripping members relative to the housing.

In another aspect still, the apparatus may a leveling ring connected to the one or more gripping members for synchronizing the movement of the one or more gripping members. The leveling ring may include one or more guide bearings movable along a guide track formed on an inner wall of an upper portion of the housing.

In another aspect still, the apparatus may include includes a flange for mounting to a rotary table. In another embodiment, the flange may include one or more blocks for mating with a rotary table. The one or more blocks minimize the rotational movement of the gripping apparatus with respect to the rotary table.

In another aspect still, the apparatus may include a cover assembly selectively attachable to the housing. The cover assembly may comprise two portions, each attachable to a respective portion of the housing. The cover assembly has a hole coaxially aligned with the opening of the housing.

In another aspect still, the apparatus may include one or more guide rollers to facilitate movement of the tubular within the housing. Preferably, the one or more guide rollers are positioned around the hole of the cover assembly in a manner capable of centering the pipe. In another embodiment, the one or more guide rollers are adjustable to accommodate different sized tubulars. In the preferred embodiment, the guide rollers include a clevis having a shaft at one end, a pin for coupling a roller to the clevis, and a mounting assembly. More preferably, the shaft is adjustable within the mounting assembly.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
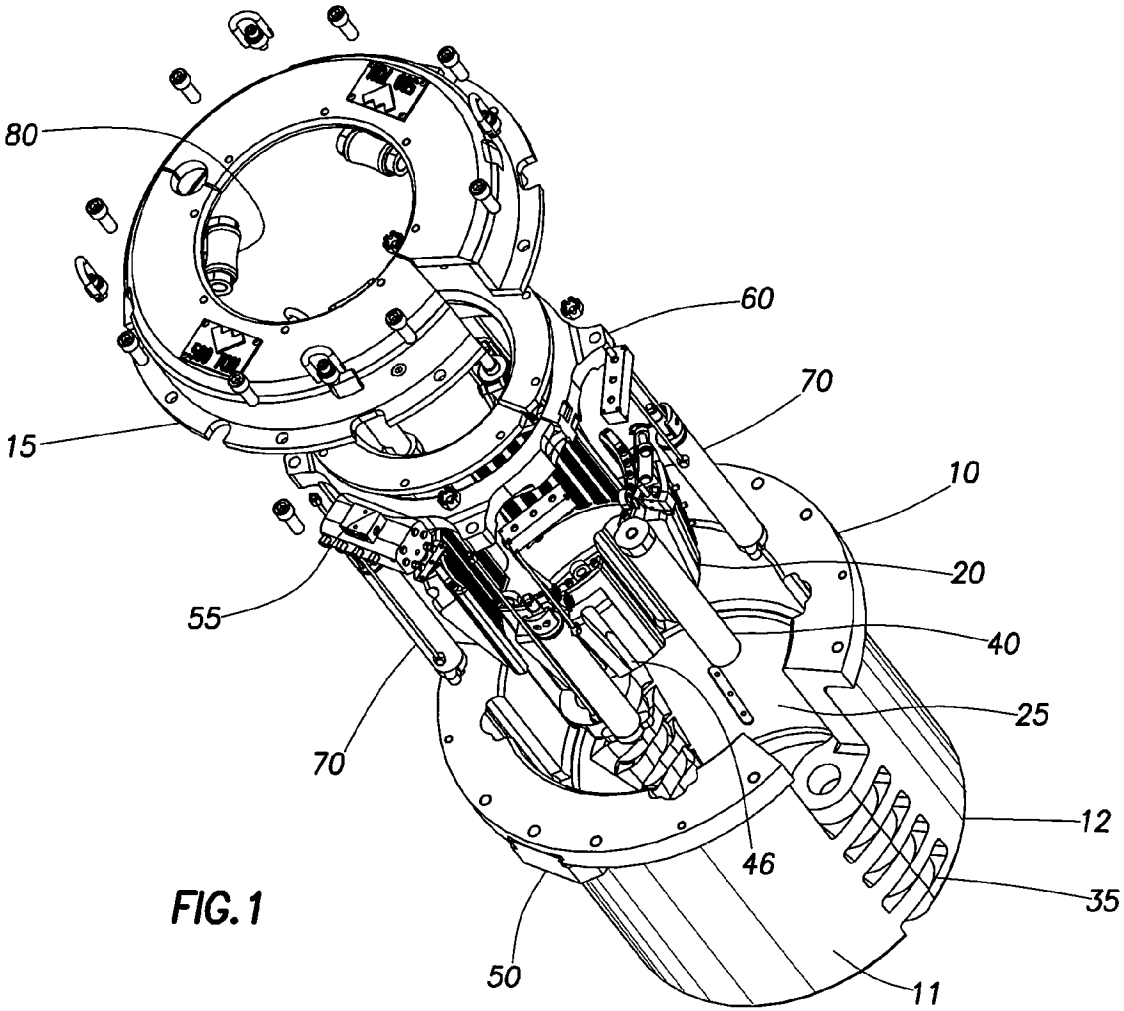
FIG. 1 shows a spider according to aspects of the present invention.

FIG. 1 shows an exemplary embodiment of a gripping apparatus 100 according to aspects of the present invention. As shown, the gripping apparatus 100 is a flush mounted spider 100 disposable within a rotary table (not shown). The spider 100 includes a body 10 for housing one or more gripping members 20 and a cover assembly 15 for the body 10.

The body 10 of the spider 100 is formed by pivotally coupling two body sections 11, 12 using one or more connectors 35. Preferably, hinges 35 formed on both sides of each body section 11, 12 are used to couple the two body sections 11, 12. Alternatively, the body sections 11, 12 may be hinged on one side and selectively locked together on the other side. A bowl 25 extends vertically through a lower portion of the body 10 to house gripping members 20 such as a slip assembly 20 as shown in FIG. 2.

Figure 2:
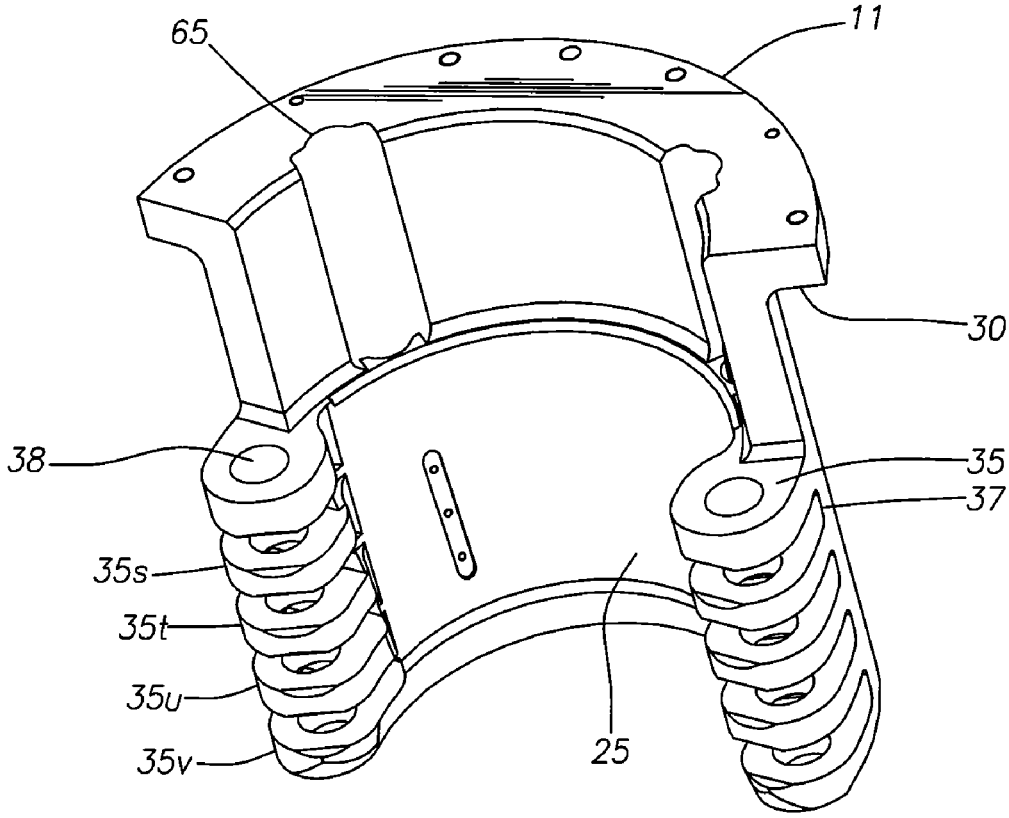
FIG. 2 is a schematic view of a section of the body of the spider shown in FIG. 1.

FIG. 2 shows one 11 of the body sections 11, 12 forming the spider body 10. A flange 30 is formed on an upper portion of the body section 11 for connection to the cover assembly 15. One or more hinges 35 are formed on each side of the body section 11. A gap 37 exists between each hinge 35 for mating with a hinge 35 formed on the other body section 12. A hole 38 is formed through each hinge 35 to accommodate a pin 40. As can be seen in the top view shown in FIG. 3, the holes 38 of the hinges 35 are aligned so that the pin 40 may be disposed through the holes 38 to secure the two body sections 11, 12 together.

Figure 3:
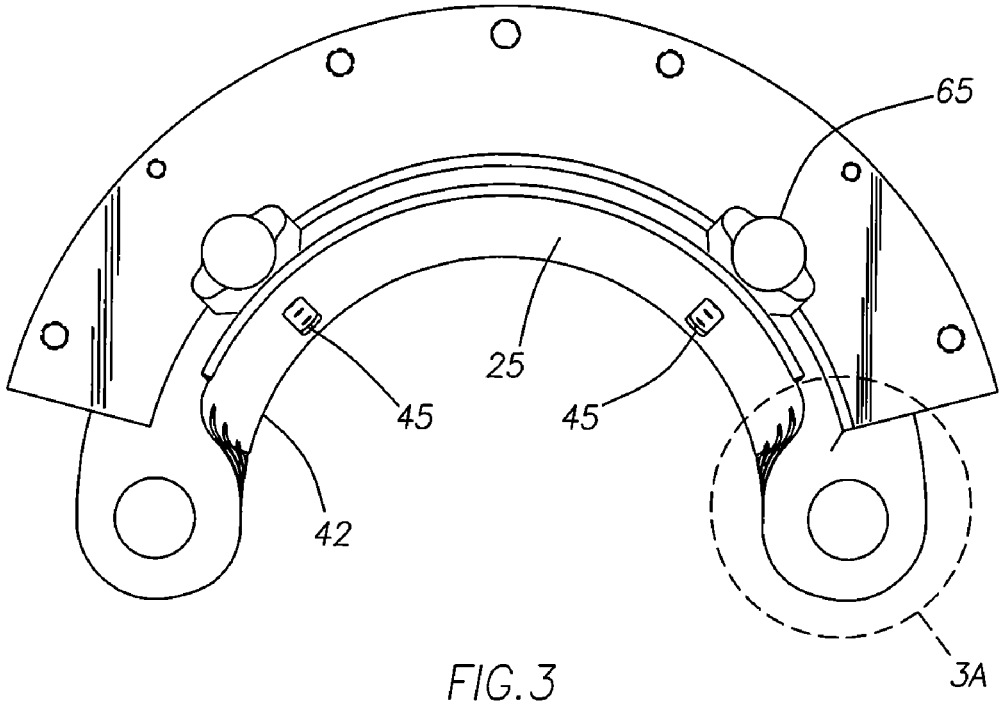
FIG. 3 is a top view of the body shown in FIG. 2.
Figure 3A:
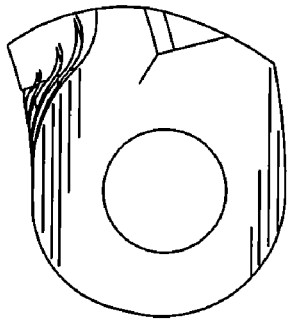
FIG. 3*a* is an exploded view of the curved hinges of the body shown in FIG. 3.
Figure 4A:
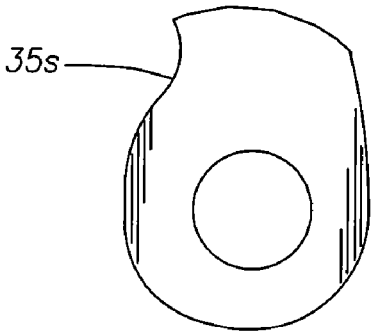
FIGS. 4*a-d* is a sectioned view of the individual hinges of FIG. 3.
Figure 4B:
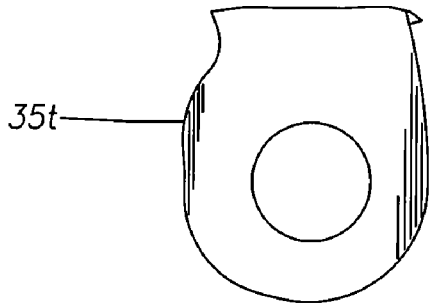
Figure 4C:
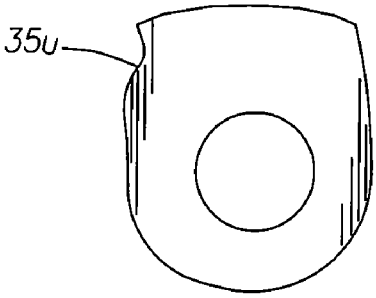
Figure 4D:
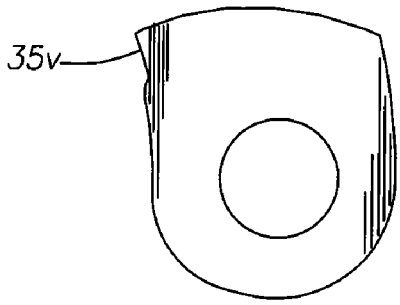

As further shown in FIG. 3, the bowl 25 for housing the slips 20 is formed as a progressive recess along the inner wall 42 of the body section 11. The progressive recess creates the inclined portion of the inner wall 42, which mates with the back of the slips 20. To accommodate the progressive recess, the hinges 35 of the body section 11 may be progressively curved as shown in FIG. 3. FIG. 3*a* is an exploded top view of the curved hinges 35.

FIGS. 4*a-d* show the hinges 35S-V in detail, respectively. The uppermost hinge 35S is the most curved hinge because the upper portion of the bowl 25 is the most recessed. As the recess of the inner wall 42 decreases toward the bottom of the bowl 25, the curve in the corresponding hinges 35S-V also progressively taper out. The curved hinges 35 allow the hinges 35 retain their capacity to support the pins 40 used to couple the two body sections 11, 12 together. The recessed bowl 25 places the slips 20 further away from the center of the spider 100, thereby creating a larger inner diameter to accommodate larger sized pipes. For example, it has been found that for a 37.5 inches rotary table, a spider having a recessed bowl with curved hinges may handle a pipe size up to about 20 inches. Whereas, a typical spider without curved hinges may only handle a pipe size up to about 14 inches. Therefore, aspects of the present invention increase the pipe size handling capacity of a spider disposed in a given rotary table size.

In another aspect, the bowl 25 of the spider 100 may include one or more guide keys 45 for guiding the axial movement of a slip 20. As illustrated in FIG. 3, one or more guide keys 45 are attached to the inner wall of the bowl 45. The guide key 45 may mate with a guide slot 46 formed longitudinally on the outer surface of the slip 20. In this manner, the guide key 45 may maintain the path of a moving slip 20. Furthermore, the guide key 45 prevents the slip 20 from rotating in the bowl 25 as it moves axially along the bowl 25. Because the slip 20 cannot rotate within the bowl 25, the spider 100 may be used as a back up torque source during the make up or break out pipe connections.

Figure 5:
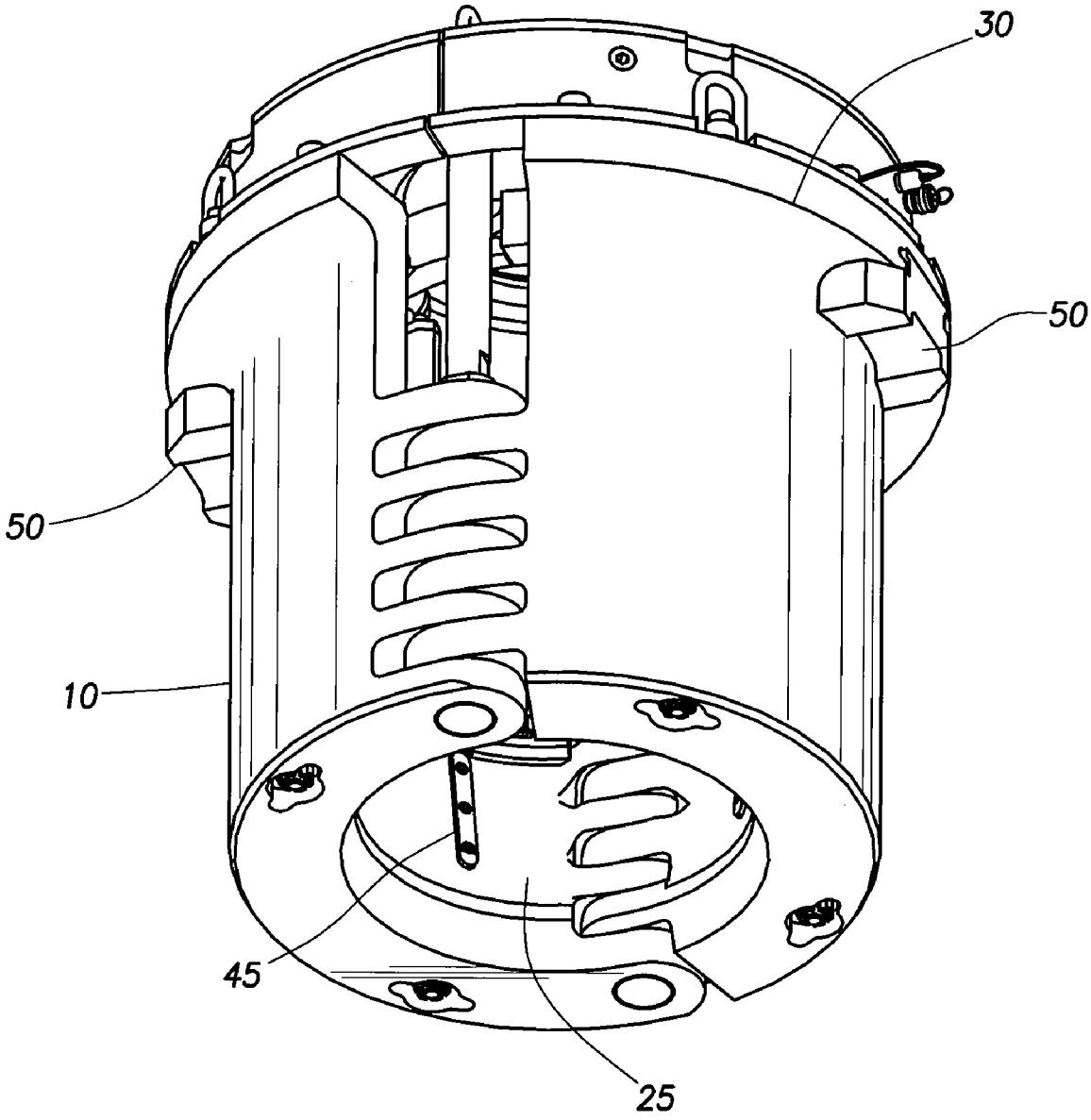
FIG. 5 shows another view of the body with a cover assembly.

In another aspect, one or more abutments 50 may be attached to a lower portion of the flange 30 of the body sections 11, 12 as illustrated in FIG. 5. The abutments 50 may comprise blocks 50 designed to mate with slots formed in the rotary table (not shown). The blocks 50 allow torque to be reacted between the spider body 100 and the rotary table. As a result, the spider 100 is prevented from rotating inside the rotary table when it is used as a back up torque source during the make up or break out pipe connections. FIG. 5 also illustrates another view of the recessed bowl 25 and guide keys 45 according to the aspects of the present invention.

Figure 6:
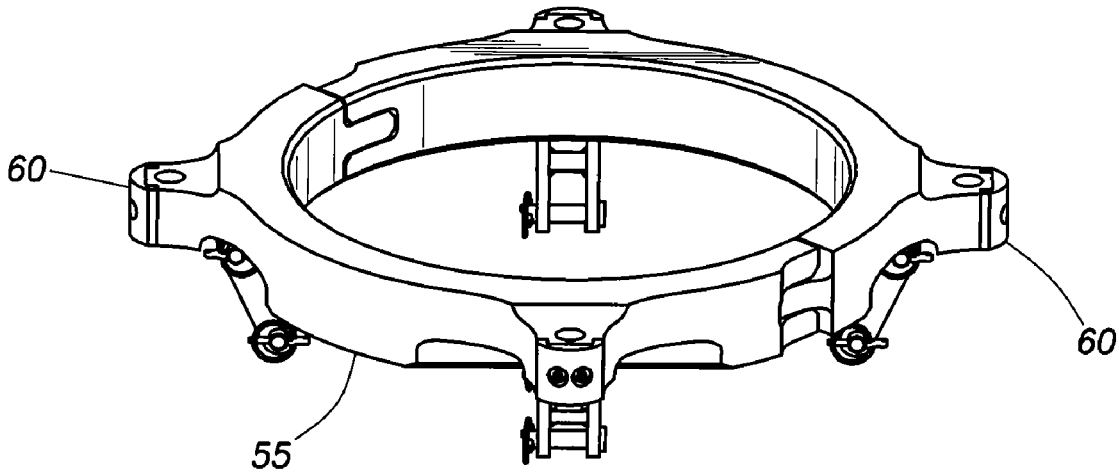
FIG. 6 shows a leveling ring usable with the spider of FIG. 1.
Figure 7:
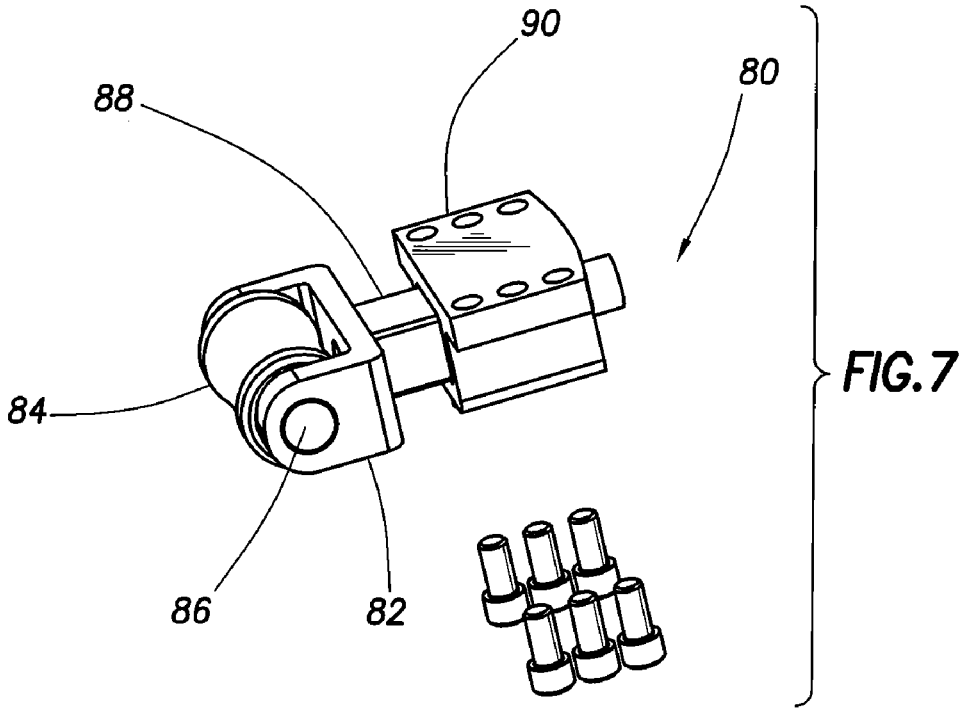
FIG. 7 shows a guide roller usable with the spider of FIG. 1.

In another aspect, the spider 100 may include a leveling ring 55 for connecting one or more slips 20 and synchronizing their vertical movement. As seen in FIGS. 1 and 6, the leveling ring 55 includes one or more guide bearings 60 extending radially from the leveling ring 55. Preferably, the leveling ring 55 has four guide bearings 60 equally spaced apart around the circumference of the leveling ring 55. For each guide bearing 60, there is a corresponding guide track 65 formed on the inner wall of the upper portion of the spider body 100 as illustrated in FIGS. 2 and 3. The guide track 65 directs the vertical movement of the leveling ring 55 and prevents the leveling ring 55 from rotating. Furthermore, the guide track 65 helps to center the pipe inside the spider 100 and provide better contact between the slips 20 and the pipe.

As shown in FIG. 1, a piston and cylinder assembly 70 may be attached below each of the guide bearings 60 and is associated with a respective slip 20. The slips 20 are disposed on the surface of the recessed bowl 25 and may be moved along the bowl 25 by the piston and cylinder assembly 70. The outer surface of the slips 20 is inclined and includes a guide slot 46 for mating with the guide key 45 of the bowl 25. The inner surface of the slips 20 may include teeth for contacting the pipe. During operation, the piston and cylinder assembly 70 may lower the slip 20 along the incline of the bowl 25. In turn, the incline directs the slip 20 radially toward the center of the spider 100, thereby moving the slip 20 into contact with the pipe. To release the pipe, the piston and cylinder 70 is actuated to move the slip 20 up the incline and away from the pipe.

The spider 100 may further include a cover assembly 15 for the body 10. The cover assembly 15 may comprise two separate sections attached above a respective body section 11, 12. The sectioned cover assembly 15 allows the body sections 11, 12 of the spider 10 to open and close without removing the cover assembly 15. The sections of the cover assembly 15 form a hole whose center coincides with the center of the body 10.

The cover assembly 15 may include one or more guide rollers 80 to facilitate the movement and centering of the pipe in the spider 100. Preferably, the guide rollers 80 are attached below the cover assembly 15 and are adjustable. The guide rollers 80 may be adjusted radially to accommodate pipes of various sizes. In one embodiment, the guide rollers 80 may comprise a roller 84 having a pin 86 coupled to a clevis 82. The clevis 82 may include a shaft 88 insertable into a mounting device 90 for attachment to the cover assembly 15. The shaft 88 is adjustable within the mounting device 90 to extend or retract the rollers 80 with respect to the mounting device 90. Preferably, the spider 100 has four roller guides 80 spaced equally apart around the center of the cover assembly 15.

In operation, spider 100 is flush mounted in rotary table. Before receiving the tubular, the guide rollers 80 are adjusted to accommodate the incoming tubular. Initially, the slips 20 are in a retracted position on the bowl 25. After the tubular is in the desired position in the spider 100, the piston and cylinder assembly 70 is actuated to move the slips 20 down along the incline of the bowl 25. The slips 20 are guided by the guide keys 45 disposed on the bowl 25. The incline causes the slips 20 to move radially toward the tubular and contact the tubular. Thereafter, the make up/break up operation is performed. To release the slips 20 from the tubular, the piston and cylinder assembly 70 is actuated to move the slips 20 up along the incline, thereby causing the slips 20 to move radially away from the tubular.

While the foregoing is directed to embodiments of the present invention, other and further embodiments of the invention may be devised without departing from the basic scope thereof, and the scope thereof is determined by the claims that follow.

We claim:

1. A gripping apparatus for supporting a tubular, comprising:

a housing having a longitudinal opening extending therethrough, wherein the housing includes at least two body parts coupled together using one or more connectors, wherein the one or more connectors has an inner distance and an outer distance from a center of the housing, and wherein the opening has a radius defined by the inner distance of the one or more connectors;

an inclined bowl formed along an inner wall of the housing, wherein the bowl has a minimum distance from the center of the housing that is at least the length of the inner distance of the one or more connectors; and a plurality of gripping members movable along a surface of the bowl.

2. The gripping apparatus of claim 1, wherein the one or more connectors are progressively curved to accommodate the inclined bowl.

3. The gripping apparatus of claim 1, wherein the one or more connectors comprise one or more hinges.

4. The gripping apparatus of claim 1, further comprising a leveling ring connected to the one or more gripping members for synchronizing the movement of the one or more gripping members.

5. The gripping apparatus of claim 1, wherein:

the housing further comprises one or more abutments for mating with a rotary table, and the one or more abutments minimize the rotational movement of the gripping apparatus with respect to the rotary table.

6. The gripping apparatus of claim 1, wherein the housing includes a flange for mounting to a rotary table.

7. The gripping apparatus of claim 1, furthering comprising a cover assembly selectively attachable to the housing.

8. The gripping apparatus of claim 7, wherein the cover assembly includes two portions, each attachable to a respective portion of the housing.

9. The gripping apparatus of claim 7, wherein the cover assembly includes a hole coaxially aligned with the opening of the housing.

10. The gripping apparatus of claim 9, further comprising one or more guide rollers to facilitate movement of the tubular, wherein the one or more guide rollers are positioned around the hole of the cover assembly in a manner capable of centering the pipe.

11. The gripping apparatus of claim 1, further comprising one or more guide rollers to facilitate movement of the tubular, wherein the one or more guide rollers are positioned in a manner capable of centering the tubular.

12. The gripping apparatus of claim 11, wherein the one or more guide rollers are adjustable to accommodate different sized tubulars.

13. The gripping apparatus of claim 1, wherein the apparatus is configured to be mounted flush with a rotary table.

14. A gripping apparatus for supporting a tubular, comprising:

a housing having a longitudinal opening extending therethrough, wherein the housing includes at least two body parts coupled together using one or more connectors, wherein the housing has an inner surface and an outer surface;

an inclined bowl formed along the inner surface of the housing, wherein a radial distance from the outer surface of the housing to an innermost portion of the bowl is no more than a width of the one or more connectors; and one or more gripping members movable along a surface of the bowl.

15. The gripping apparatus of claim 14, wherein the one or more connectors are progressively curved to accommodate the inclined bowl.

16. The gripping apparatus of claim 15, wherein the one or more connectors comprise one or more hinges.

17. The gripping apparatus of claim 14, wherein the housing includes a flange for mounting to a rotary table.

18. The gripping apparatus of claim 17, further comprising a leveling ring connected to the one or more gripping members for synchronizing the movement of the one or more gripping members.

19. The gripping apparatus of claim 17, further comprising one or more guide rollers to facilitate movement of the tubular, wherein the one or more guide rollers are positioned in a manner capable of centering the tubular.

* * * * *